United States Patent [19]

Petersen

[11] 4,203,269

[45] May 20, 1980

[54] PACKAGING APPARATUS

[76] Inventor: Gunnar C. Petersen, No. 14 Rødkildevanget, 5230 Odense, Denmark

[21] Appl. No.: 4,543

[22] Filed: Jan. 18, 1979

[30] Foreign Application Priority Data

Jan. 27, 1978 [DK] Denmark ..... 408/78

[51] Int. Cl.[2] ..... B65B 57/12; B65B 43/36

[52] U.S. Cl. ..... 53/77; 53/525; 53/572; 53/258

[58] Field of Search ..... 53/77, 525, 572, 258

[56] References Cited

U.S. PATENT DOCUMENTS

| | | | |
|---|---|---|---|
| 3,339,338 | 9/1967 | Brinck et al. | 53/572 |
| 3,935,691 | 2/1976 | Broch | 53/572 X |

*Primary Examiner*—Travis S. McGehee

*Attorney, Agent, or Firm*—Kenyon & Kenyon

[57] ABSTRACT

Apparatus for batchwise transfer of articles to a receptacle comprises an elongate, upwardly open tray which is longitudinally reciprocable between a loading position and an unloading position. An article receiving compartment within the tray is defined rearwardly by a pusher and forwardly by a hinged flap. When a portion of articles has been loaded into the compartment, the tray is subjected to a longitudinal shaking action. The tray is then moved to its unloading position wherein the compartment therein is located within a receptacle. During this movement the flap hits against a stationary abutment whereby it is pivoted clear of the front end of the compartment. Subsequently, the tray is withdrawn to its loading position and simultaneously the pusher is moved forward relative to the tray whereby the articles are transferred gently from the compartment to the receptacle. During the backward movement of the tray the flap pivots back to its closing position and when the tray has been retracted the pusher is retracted to its initial position.

7 Claims, 6 Drawing Figures

PACKAGING APPARATUS

BACKGROUND OF THE INVENTION

This invention relates to packaging apparatus, more specifically to apparatus for transferring a portion or batch consisting of several articles from an apportioning device to a receptacle. It is an object of the invention to provide a fast operating and efficient apparatus for compact or dense packaging of articles, in particular articles of more or less irregular form such as carrots and other vegetables, and markedly elongate articles such as sausages.

SUMMARY OF THE INVENTION

According to the present invention there is provided an apparatus for the batch-wise transfer of articles from an apportioning device to a receptacle, comprising a frame, an elongate tray of U-shaped, upwardly open cross-section, means for reciprocating the tray longitudinally on the frame between a retracted position in which the front end of the tray is located opposite the mouth of an open receptacle, and an advanced position in which the tray has been inserted in the receptacle, a closure flap pivotable on a transverse axis adjacent the front edge of the tray between an operative position which it assumes when the tray is retracted and in which it closes the front end of the tray, and an inoperative position in which it leaves said front end open, a pusher connected to the tray and movable relative thereto in the longitudinal direction of the tray, which pusher when retracted relative to the tray forms the rear wall of an open-top compartment within the tray, means for introducing a portion of articles into the compartment in the retracted position of the tray, means for shaking the tray in the longitudinal direction thereof, and a stationary abutment means adapted to cooperate with an upward extension of the closure flap for pivoting the flap from its operative position to its inoperative position during insertion of the tray into the receptacle.

By means of an apparatus according to the invention the tray may, after a portion of the articles in question has been loaded into the compartment from above, be subjected to a shaking longitudinal movement whereby the articles are brought closer together so that their total volume and, hence, the necessary volume of the receptacle to which they are to be transferred, is reduced. The shaking movement will also cause elongate articles to be oriented or aligned such that finally the longitudinal direction of each article coincides, at least substantially, with the longitudinal direction of the compartment. It is essential for the efficiency of the shaking movement that the closure flap and the pusher located at the front and rear end, respectively, of the compartment participate in the movement. When the tray is subsequently inserted into an open receptacle, the closure flap pivots to its inoperative position so that a subsequent withdrawal of the tray accompanied by a synchronous or substantially synchronous forward movement of the pusher relative to the tray whereby the pusher remains stationary relative to the receptacle, will cause the articles to be transferred from the tray to the lower wall of the receptacle without any appreciable disturbance of their densely packed arrangement.

An embodiment of the apparatus especially advantageous for packaging elongate articles is characterized in that the upward extension of the closure flap is dimensioned so as to cover the open upper side of the compartment when the flap is in its inoperative position. The compartment will then be closed upwardly when it is moved into and out of the receptacle so that jamming of the tray by an article projecting upwardly from the compartment is prevented.

In a structurally simple embodiment of the invention the means for reciprocating the tray consists of a first pneumatic ram having a piston rod secured to the frame of the apparatus, and the means for shaking the tray consists of a second pneumatic ram built together with the first ram in extension thereof and having a piston rod secured to the tray.

For keeping the closure flap in its operative position during the shaking of the tray there may be provided a tension spring located at the rear end of the tray and connected at one end thereto, and a drawbar extending along one side wall of the tray and connecting the other end of the spring with the closure flap. Due to the location of the spring at the rear end of the tray and the location of the drawbar closely adjacent the tray these elements do not materially increase the cross-sectional area of the receptacle necessary for the insertion of the tray.

The pivot axis of the closure flap may be located at a distance rearwardly from the front end of the tray and approximately midway along the height of the tray. In this way it can be ensured that in the inoperative position of the flap its lowermost edge is substantially flush with the front end of the tray which, consequently, can be moved right to the bottom of the receptacle in its advanced position.

The apparatus may comprise a plate pivotable about an axis which is parallel to the pivot axis of the closure flap and located closely in front of and at a lower level than the abutment means. When the articles are packed directly into a bag, the plate may serve to keep the walls of the bag suitable spread apart. The plate may also be utilized for preventing damage to the components of the apparatus or to the articles, in case the movement of the tray into the receptacle is hampered. For obtaining this security function the plate may be hinged to a yoke which is pivotable about a horizontal axis and biased downwardly towards a stop, the yoke being operatively connected to means for interrupting movement of the tray when the yoke is lifted.

BRIEF DESCRIPTION OF THE DRAWINGS

The invention will now be described in more detail with reference to the accompanying schematic drawings in which.

DETAILED DESCRIPTION

Figure 1:
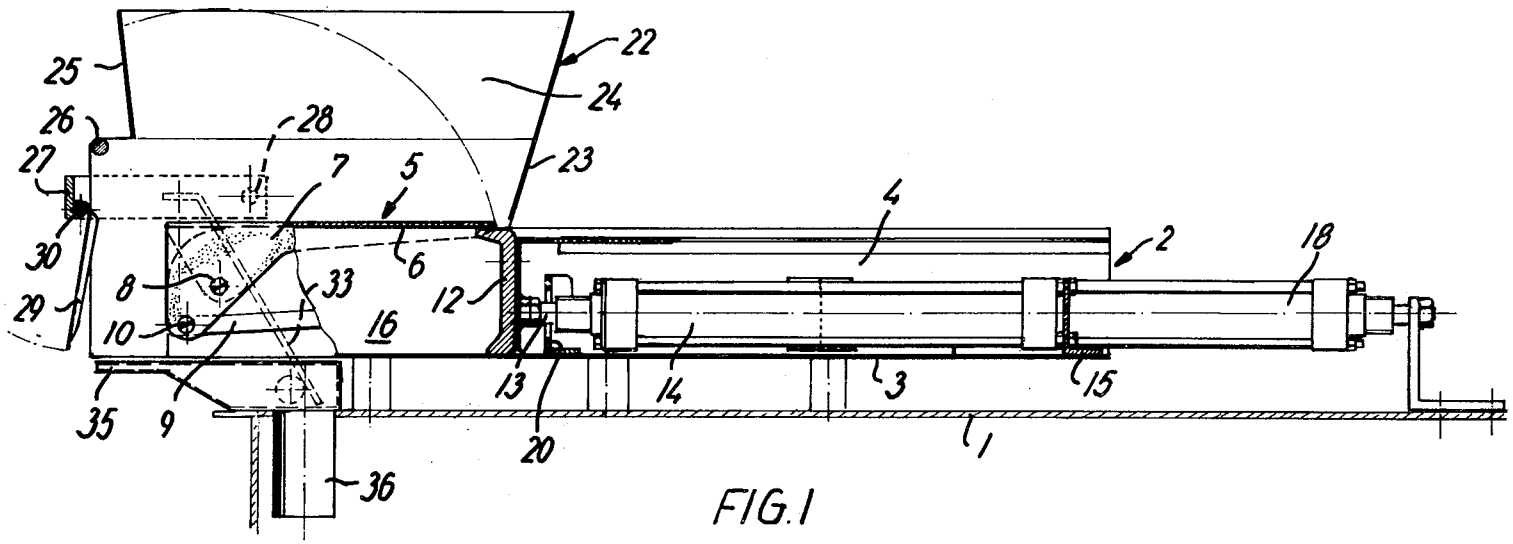
FIG. 1 is a longitudinal section through an apparatus embodying the present invention.
Figure 2:
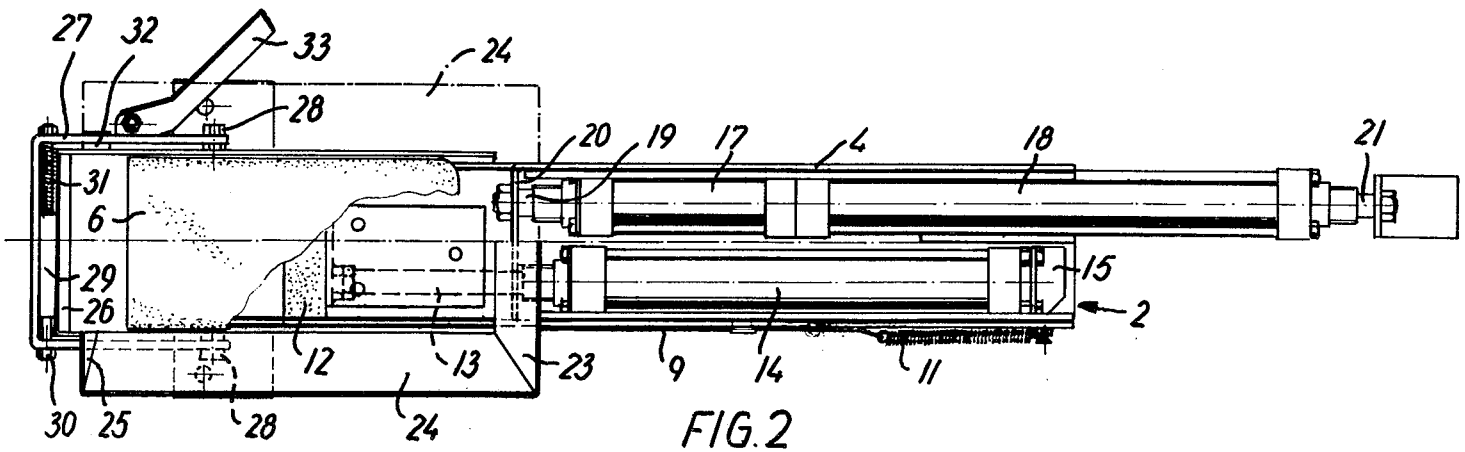
FIG. 2 is a plan view of FIG. 1, and FIGS. 3–6 are longitudinal sections corresponding to FIG. 1 and showing the essential parts of the apparatus in four successive stages of a packaging operation.
Figure 3:
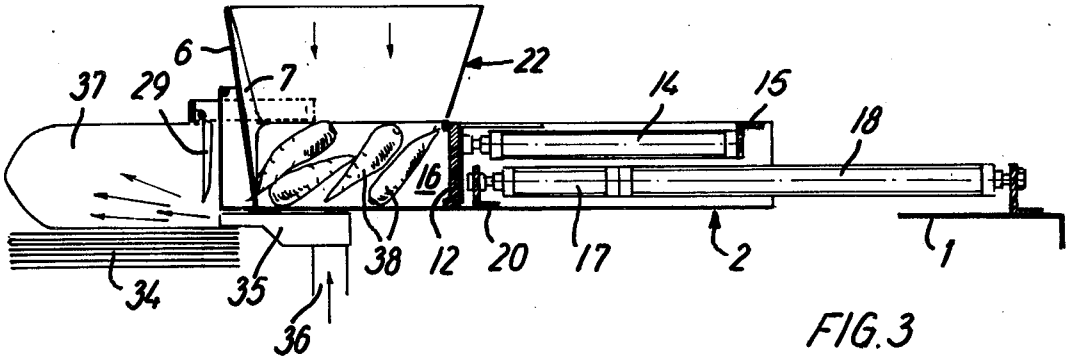
Figure 4:
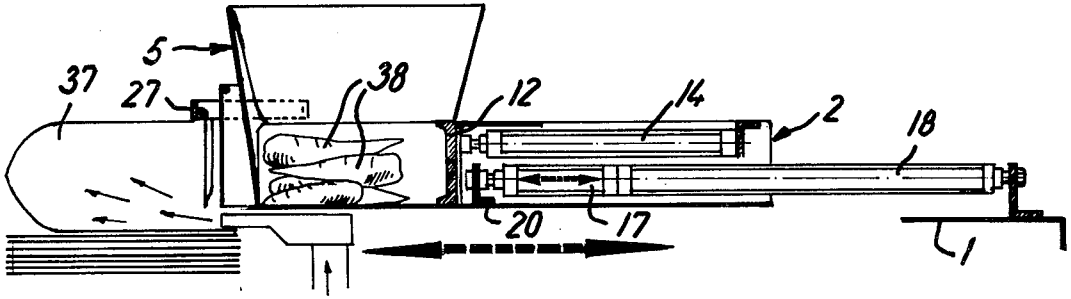
Figure 5:
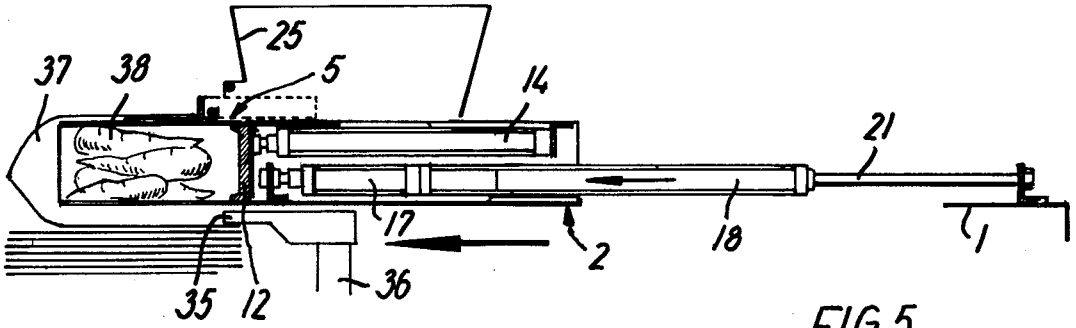
Figure 6:
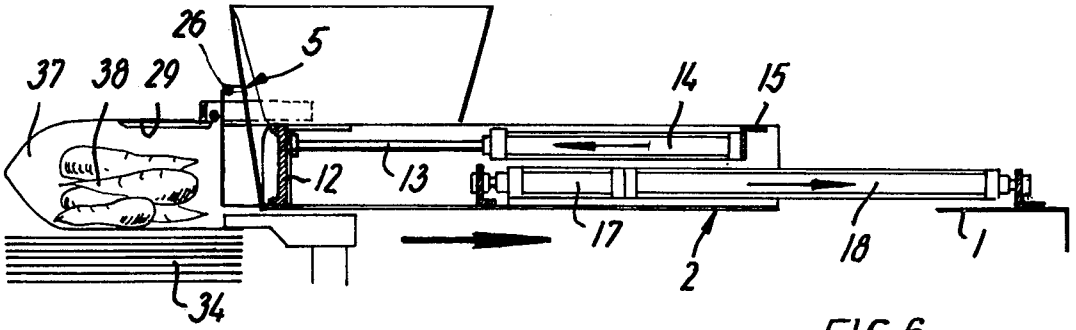

As shown in the drawings the apparatus comprises a frame 1, not shown in detail, which is formed with guide means for a longitudinally movable, elongate tray 2. Tray 2 may be made of sheet metal and comprises a bottom wall 3 and two side walls 4 so that it is upwardly open. A closure flap generally designated by 5 is hinged to the tray at the forward end thereof, i.e. the left-hand end as shown in the figures of the drawings. Flap 5 comprises a flat central panel 6 and two side panels 7 each lying closely adjacent and exterior to one side wall 4. Flap 5 pivots relative to tray 2 about a horizontal axis defined by two hinge pins 8 located approximately midway of the height of walls 4 and at such a distance from the front end of the tray that when the flap is in its operative position, as seen in FIGS. 3, 4, and 6, panel 6 closes the open front end of tray 2 whereas when the flap has been pivoted to an inoperative position as seen in FIGS. 1, 2, and 5, the forward edge of panel 6 is substantially flush with the front end of the tray.

A drawbar 9 is hinged at 10 to one of the side panels 7 below hinge pin 8 (see FIG. 1) and at its rear end bar 9, which extends closely to the associated side wall 4, is connected to a tension spring 11, the opposite end of which is secured to the side wall 4 (see FIG. 2). When tray 2 assumes its retracted position shown in FIGS. 3, 4, and 6, flap 5 can freely pivot upwardly due to the force exerted by spring 11, as indicated by a dot-and-dash line in FIG. 1. Only for the sake of clarity flap 5 has been shown in its horizontal or inoperative position in FIGS. 1 and 2.

A pusher 12 extends transversely of tray 2 throughout the height and width thereof between side walls 4. To the rear side of pusher 12 there is secured a piston rod 13 of a double-acting pneumatic ram 14, the cylinder of which is secured to the bottom wall 3 of tray 2 by means of an angle bar 15. When pusher 12 is retracted relative to tray 2, as shown in FIGS. 1, 3, 4, and 5, it forms the rear wall of an upwardly open compartment 16 within the tray. When pusher 12 is in its relative forward position shown in FIG. 6, it is substantially aligned with the front edge of the tray.

Two further double-acting pneumatic rams 17 and 18 are built together in axial alignment with a partition wall between adjacent working chambers within their respective cylinders. The piston rod 19 of ram 17 is connected to the bottom wall 3 by means of an angle bar 20, and the piston rod 21 of ram 18 is connected to frame 1. For the sake of clarity the two rams 14 and 17, which in fact are located behind one another as seen in FIGS. 1 and 2, have been shown one above the other in FIGS. 3–6.

Above the movable tray 2 there is provided a stationary hopper 22 having an inclined rear wall 23 and two inclined side walls 24 which at their front end are joined to inturned triangular panels 25. The space between panels 25 is closed—with a suitable clearance—by the central panel 6 of flap 5 when the flap assumes its upright or operative position shown in FIGS. 3, 4, and 6. The dimensions of the lower opening of hopper 22 correspond substantially to those of compartment 16 between pusher 12 and the upright central panel 6 of flap 5.

Adjacent and in front of hopper panels 25 there is provided a transverse, stationary abutment 26, which is engaged by panel 6, when the tray has moved a short distance forward from its retracted position. Below abutment 26 a U-shaped yoke 27 is hinged to the side walls of the hopper at 28 and a transverse plate 29 is hinged to the yoke at 30 and biased towards the position shown in FIG. 1 by means of torsion spring 31. Normally yoke 27 assumes the position shown in FIGS. 1 and 2 which is defined by a stop 32 and if the yoke pivots upwardly on its hinges 28, an arm 33 secured to the yoke actuates a switch (not shown) which through the pneumatic control system of the apparatus retracts tray 2 to its rearward end position.

On the frame of the apparatus there is mounted means (not shown in detail) for accommodating a stack of flattened bags 34, see FIGS. 3–6, and below the path of tray 2 an elongate nozzle 35 is secured to the frame. When pressurized air is supplied to nozzle 35 through a duct 36, air is blown into the uppermost bag 37 of the stack, whereby the bag is opened as shown in FIGS. 3–6.

Referring to FIGS. 3–6 the function of the apparatus will now be described in connection with the packaging of a portion or batch of articles 38 which are shown as being carrots. The batch may be apportioned in advance, e.g. by counting if the individual articles are of substantially uniform weight, or by weighing if there are large deviations between the weight of each article and/or if uniform weight of each packaged batch is desired.

The device (not shown) for apportioning the articles, e.g. an automatic weighing machine, delivers at suitable intervals a batch or portion of articles through hopper 22 into compartment 16 when the components of the apparatus assume the positions shown in FIG. 3. When the articles have been placed in compartment 16, pressurized air is supplied alternately and at a high switching rate to either of the two working chambers in ram 17 whereby tray 2 is shaken rapidly and with a relatively high amplitude or travel, such as about 50 mm, in its longitudinal direction. The shaking movements of the tray cause articles 38 to be aligned in the longitudinal direction of the tray and simultaneously they are packed densely within compartment 16, as shown in FIG. 4. During filling of the compartment and the subsequent shaking of the tray, spring 11 keeps flap 5 in its upright position so that the flap closes the front end of the compartment and participates in the shaking movements together with pusher 12 forming the rear wall of the compartment. The duration of the shaking movement will normally be controlled by a timer, which preferably is adjustable.

When the shaking has been terminated and the articles have been packed together as shown in FIG. 4, pressurized air is supplied to the working chamber at the left of the piston (not shown) of ram 18. This moves the entire tray including flap 5 and pusher 12 forwardly towards bag 37 which has previously been opened by the air supplied through nozzle 35. After a short travel of the tray the central panel 6 of closure flap 5 engages abutment 26 whereby the flap is pivoted clockwise on its hinge axis 8. During the movement of the tray towards the left panel 6 also engages the hinged plate 29, which is then pivoted upwardly into bag 37. When the movement has been terminated the articles within compartment 16 have been inserted in bag 37 as seen in FIG. 5. In this position panel 6 is horizontal so that it closes the upper opening of compartment 16.

Through the control system (not shown) of the various pneumatic rams pressurized air is next supplied to the working chamber at the right-hand end of ram 14, whereby pusher 12 moves to the left relative to the tray. At the same time and at the same or substantially the same rate air is supplied to the working chamber at the right-hand end of ram 18 whereby the entire tray is retracted towards its right-hand end position. In FIG. 6 these two simultaneous movements have been illustrated by arrows on the rams and below the tray. Due to the synchronization of the movements pusher 12 remains stationary relative to the frame of the apparatus and, hence, to bag 37 and to the articles 38 in compartment 16. Thus, the articles are deposited, without alteration or disturbance of their mutual positions, on the lower wall of the bag and when the tray has been fully retracted, the filled bag can be removed for any further processing, including closing thereof. For terminating the operational cycle of the apparatus pressurized air is supplied to the left-hand working chamber of ram 14 whereby pusher 12 is retracted to its initial position relative to the tray, as seen in FIG. 3. This movement may release a signal permitting transfer of a subsequent batch of articles to compartment 16 for initiating the next working cycle.

If the movement of tray 2 into bag 37 should encounter an obstacle, e.g. because an article 38 protrudes above the upper limit of compartment 16, yoke 27 will be raised whereby a switch (not shown) will be actuated by arm 33 to discontinue the air supply to ram 18 and open for the supply of pressurized air to the opposite working chamber of that ram so that the tray is immediately retracted to its initial position. The operator may then remove the article, which caused the jamming.

While the invention has been described in connection with the packaging of articles in bags, it will be understood that the apparatus can readily be modified to package the articles in rigid containers, such as tins or glass jars. It can also be adapted to transfer the articles from the tray to an intermediate receptacle, e.g. a cell closed at its top and sides and forming part of an turret or other intermediate conveyor means which transfers the apportioned batch of articles to a separate packaging station in which the batch is transferred from the intermediate receptacle to the ultimate container etc. The control system (not shown) of the apparatus may comprise suitable control devices, such as sensors and/or valves which ensure that each partial operation can only be initiated when the preceding partial operation has been correctly completed.

Apparatus constructed in accordance with the invention are suited for packaging not only elongate articles including carrots and sausages, but also for other articles such as potatoes or onions, where the shaking of the tray does not result in any particular orientation of the articles but only reduces the volume of the batch and thus provides a better utilization of the package volume.

I claim:

1. Apparatus for the batch-wise transfer of articles from an apportioning device to a receptacle, comprising a frame, an elongate tray of U-shaped, upwardly open cross-section, means for reciprocating the tray longitudinally on the frame between a retracted position in which the front end of the tray is located opposite the mouth of an open receptacle, and an advanced position in which the tray has been inserted in the receptacle, a closure flap pivotable on a transverse axis adjacent the front end of the tray between an operative position which it assumes when the tray is retracted and in which it closes the front end of the tray, and an inoperative position in which it leaves said front end open, a pusher connected to the tray and movable relative thereto in the longitudinal direction of the tray, which pusher, when retracted relative to the tray, forms the rear wall of an open-top compartment within the tray, means for introducing a portion of articles into the compartment in the retracted position of the tray, means for shaking the tray in the longitudinal direction thereof, and a stationary abutment means adapted to cooperate with an upward extension of the closure flap for pivoting the flap from its operative position to its inoperative position during insertion of the tray into the receptacle.

2. Apparatus as claimed in claim 1, wherein the upward extension of the closure flap is dimensioned so as to cover the open upper side of the compartment when the flap is in its inoperative position.

3. Apparatus as claimed in claim 1, wherein the means for reciprocating the tray consists of a first pneumatic ram having a piston rod secured to the frame of the apparatus, and the means for shaking the tray consists of a second pneumatic ram built together with the first ram in extension thereof and having a piston rod secured to the tray.

4. Apparatus as claimed in claim 1, further comprising at least one tension spring located at the rear end of the tray and connected at one end thereto, and a drawbar extending along one side wall of the tray and connecting the other end of the spring with the closure flap for maintaining the flap in its operative position.

5. Apparatus as claimed in claim 1, wherein the pivot axis of the closure flap is located at a distance rearwardly from the front end of the tray and approximately midway along the height of the tray.

6. Apparatus as claimed in claim 1, further comprising a plate pivotable on an axis, which is parallel to the pivot axis of the closure flap and located closely in front of and at a lower level than the abutment means.

7. Apparatus as claimed in claim 6, wherein the plate is hinged to a yoke which is pivotable about a horizontal axis and biased downwardly towards a stop, the yoke being operatively connected to means for interrupting movement of the tray when the yoke is lifted.

* * * * *